US009316939B2

(12) United States Patent
Mizumoto et al.

(10) Patent No.: US 9,316,939 B2
(45) Date of Patent: Apr. 19, 2016

(54) LIQUID DEVELOPER

(71) Applicant: Konica Minolta, Inc., Chiyoda-ku (JP)

(72) Inventors: Nofumi Mizumoto, Nara (JP); Naoki Yoshie, Ibaraki (JP); Yuya Iwagoe, Kyoto (JP); Satoshi Matsumoto, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/481,039

(22) Filed: Sep. 9, 2014

(65) Prior Publication Data

US 2015/0072288 A1 Mar. 12, 2015

(30) Foreign Application Priority Data

Sep. 10, 2013 (JP) ..... 2013-187316

(51) Int. Cl.

| | |
|---|---|
| ***G03G 9/13*** | (2006.01) |
| ***G03G 9/093*** | (2006.01) |
| ***G03G 9/125*** | (2006.01) |

(52) U.S. Cl.

CPC ..... *G03G 9/132* (2013.01); *G03G 9/09307* (2013.01); *G03G 9/09371* (2013.01); *G03G 9/125* (2013.01)

(58) Field of Classification Search

CPC ... G03G 9/132; G03G 9/125; G03G 9/09307; G03G 9/09371

USPC ..... 430/114, 112

See application file for complete search history.

(56) References Cited

U.S. PATENT DOCUMENTS

| | | | | |
|---|---|---|---|---|
| 2013/0115550 | A1 | 5/2013 | Amemori et al. | |
| 2014/0370436 | A1 * | 12/2014 | Yoshie et al. ..... | 430/115 |

FOREIGN PATENT DOCUMENTS

| | | | |
|---|---|---|---|
| JP | 2009-096994 | A | 5/2009 |
| JP | 2012-107229 | A | 6/2012 |
| JP | 2013-015555 | A | 1/2013 |
| JP | 2013-101264 | A | 5/2013 |
| JP | 2013-130791 | A | 7/2013 |

* cited by examiner

*Primary Examiner* — Janis L Dote

(74) *Attorney, Agent, or Firm* — Buchanan Ingersoll & Rooney PC

(57) ABSTRACT

A liquid developer is obtained by dispersing toner particles containing a core resin, a shell resin different from the core resin, and a coloring agent in an insulating liquid. The core resin contains a crystalline urethane-modified polyester resin. A solid content of the liquid developer corresponding to a portion of the liquid developer excluding the insulating liquid has a storage elastic modulus at 80° C., not lower than $1\times10^4$ Pa and not higher than $5\times10^6$ Pa. A lowest temperature at the time when an absolute value of an amount of change in a logarithmic value (log(G')) of a storage elastic modulus (G') of the solid content of the liquid developer with respect to a temperature T (° C.) ($|\Delta \log(G')/\Delta T|$) satisfies an Equation (1) below is not lower than 45° C.:

$$|\Delta \log(G')/\Delta T|>0.1 \quad \text{Equation (1).}$$

4 Claims, 4 Drawing Sheets

LIQUID DEVELOPER

This application is based on Japanese Patent Application No. 2013-187316 filed with the Japan Patent Office on Sep. 10, 2013, the entire content of which is hereby incorporated by reference.

BACKGROUND OF THE INVENTION

1. Field of the Invention

The present invention relates to a liquid developer containing an insulating liquid and toner particles dispersed in the insulating liquid.

2. Description of the Related Art

In recent years, in order to reduce energy consumed during fixation, development of a liquid developer excellent in low-temperature fixability has been promoted. For example, according to Japanese Laid-Open Patent Publication No. 2012-107229, a liquid developer excellent in low-temperature fixability can be provided when particle size distribution of toner particles contained in the liquid developer is narrow and a shape of the toner particles is uniform.

When a liquid developer excellent in low-temperature fixability is employed, however, molten toner tends to adhere to a fixation roller during fixation. This is called high-temperature offset, in which a liquid developer may offset to such a recording medium as paper when a fixation roller is contaminated. Therefore, in development of a liquid developer excellent in low-temperature fixability, occurrence of high-temperature offset is preferably suppressed while moderate gloss and fixation strength are ensured.

When a liquid developer excellent in low-temperature fixability is employed and when a printed matter obtained by fixing toner particles to a recording medium is stored in a high-temperature condition or a pressurized condition, toner particles tend to be softened and color transfer is likely. This is called document offset. Therefore, in development of a liquid developer excellent in low-temperature fixability, occurrence of document offset is also preferably suppressed while moderate gloss and fixation strength are ensured.

SUMMARY OF THE INVENTION

The present invention provides a liquid developer excellent in low-temperature fixability, with which occurrence of high-temperature offset and document offset is prevented while moderate gloss and fixation strength are ensured.

A liquid developer according to the present invention includes an insulating liquid and toner particles dispersed in the insulating liquid. The toner particles contain a core resin, a shell resin different from the core resin, and a coloring agent. The core resin contains a crystalline urethane-modified polyester resin. A solid content of the liquid developer corresponding to a portion of the liquid developer excluding the insulating liquid has a storage elastic modulus at 80° C., not lower than $1\times10^4$ Pa and not higher than $5\times10^6$ Pa. A lowest temperature at the time when an absolute value of an amount of change in a logarithmic value (log(G')) of the storage elastic modulus (G') of the solid content of the liquid developer with respect to a temperature T (° C.) ($|\Delta \log(G')/\Delta T|$) satisfies an Equation (1) below is not lower than 45° C.:

$$|\Delta \log(G')/\Delta T|>0.1 \quad \text{Equation (1).}$$

Preferably, x and y satisfy Equations (2) to (4) below:

$$y\leq-0.0002x+11 \quad \text{Equation (2);}$$

$$10000\leq x\leq50000 \quad \text{Equation (3); and}$$

$$1\leq y\leq7 \quad \text{Equation (4),}$$

where x represents a number average molecular weight of the urethane-modified polyester resin and y represents a concentration of a urethane group in the urethane-modified polyester resin.

Preferably, the solid content of the liquid developer has a storage elastic modulus at 80° C., not lower than $5\times10^4$ Pa and not higher than $1\times10^6$ Pa.

Preferably, the shell resin has a glass transition point not lower than 50° C.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
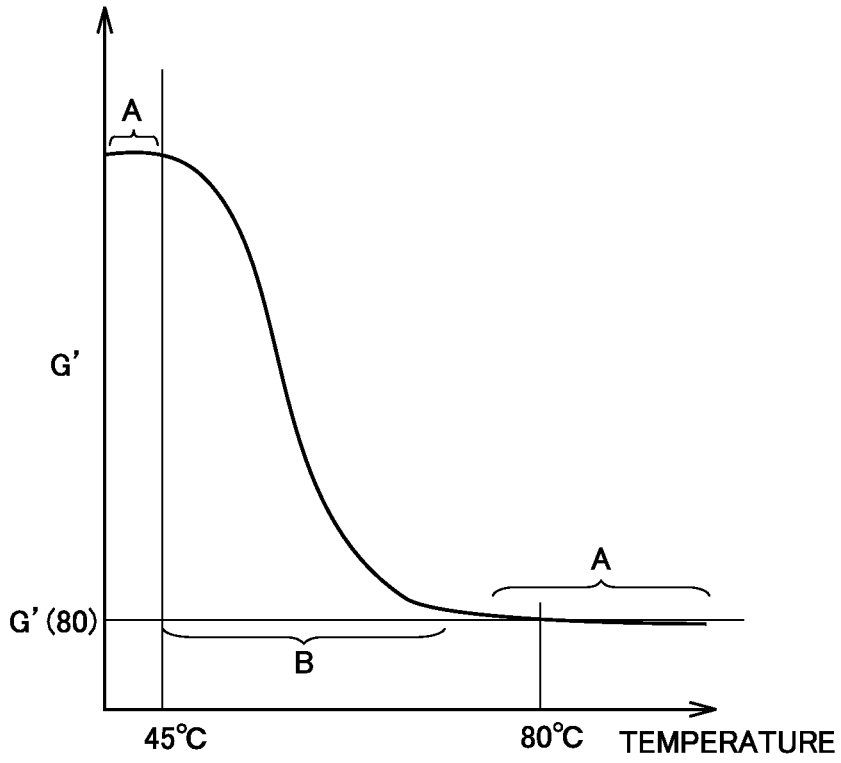
FIG. 1 is a graph schematically showing temperature dependency of a storage elastic modulus (G') of a solid content of a liquid developer according to one embodiment of the present invention.

Definition herein of terms and a method of measuring physical properties will be summarized below.

<Crystallinity>

Crystallinity means that a ratio between a softening point of a resin (hereinafter abbreviated as "Tm") and a maximum peak temperature (hereinafter abbreviated as "Ta") of heat of fusion of the resin (Tm/Ta) is not lower than 0.8 and not higher than 1.55 and that a result of change in amount of heat obtained in differential scanning calorimetry (DSC) does not show stepwise change in amount of heat absorption but has a clear heat absorption peak. A ratio between Tm and Ta (Tm/Ta) being higher than 1.55 can mean that such a resin is not excellent in crystallinity and also that such a resin has non-crystallinity.

A flow tester (capillary rheometer) (such as CFT-500D manufactured by Shimadzu Corporation) can be used to measure Tm. Specifically, while 1 g of a sample is heated at a temperature increase rate of 5° C./min., a plunger applies load of 1.96 MPa to the sample to thereby extrude the sample from a nozzle having a diameter of 0.5 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (such as "DSC210" manufactured by Seiko Instruments, Inc.) can be used to measure Ta. Initially, a sample is subjected to pre-treatment. Specifically, a sample is molten at 130° C., thereafter a temperature is lowered from 130° C. to 70° C. at a rate of 1.0°

C./min., and thereafter a temperature is lowered from 70° C. to 10° C. at a rate of 0.5° C./min. Thereafter, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'−10)° C., it is in turn stored for 6 hours at (Ta'−15)° C.

After pre-treatment of the sample ends, with the DSC method, the sample subjected to the pre-treatment above is cooled to 0° C. at a temperature lowering rate of 10° C./min., and then a temperature is raised at a temperature increase rate of 20° C./min. Based on change in heat absorption and generation thus measured, relation between an "amount of heat absorption and generation" and a "temperature" is plotted in a graph. A temperature at which an amount of heat absorption attains to a maximum value is defined as a maximum peak temperature (Ta) of heat of fusion.

<Urethane-Modified Polyester Resin>

A urethane-modified polyester resin means a urethane-modified polyester resin resulting from increase in chain length of a component derived from a polyester resin by a compound containing an isocyanate group. The "component derived from the polyester resin" means a polyester resin from which one or more atoms have been removed from terminal end(s), and it includes a polyester resin from which one hydrogen atom has been removed from each of opposing terminal ends and a polyester resin from which one hydrogen atom has been removed from one terminal end. A "chain length" means bonding between a component derived from a polyester resin and a compound containing an isocyanate group such that the urethane-modified polyester resin is linear.

<Concentration of Urethane Group in Crystalline Urethane-Modified Polyester Resin>

A concentration of a urethane group in a crystalline urethane-modified polyester resin is represented by a value defined as (a mass of a urethane group contained in a crystalline urethane-modified polyester resin)/(a mass of the crystalline urethane-modified polyester resin)×100, and can be measured with a gas chromatograph mass spectrometer (GCMS). A concentration of a urethane group in the crystalline urethane-modified polyester resin herein is represented by a value measured with the GCMS under conditions shown below after the crystalline urethane-modified polyester resin is thermally decomposed under conditions shown below. Specifically, a concentration of a urethane group in the crystalline urethane-modified polyester resin is calculated by using a ratio of ion intensity detected from the thermally decomposed urethane-modified polyester resin.

(Conditions for Pyrolysis of Crystalline Urethane-Modified Polyester Resin)

Apparatus: PY-20201D manufactured by Frontier Laboratories Ltd.

Mass of Sample: 0.1 mg

Heating Temperature: 550° C.

Heating Time Period: 0.5 minute (Conditions for Measurement of Concentration of Urethane Group in Crystalline Urethane-Modified Polyester Resin)

Apparatus: GCMS-QP2010 manufactured by Shimadzu Corporation

Column: UltraALLOY-5 manufactured by Frontier Laboratories Ltd. (inner diameter: 0.25 mm, length: 30 m, thickness: 0.25 μm)

Temperature Increase Condition:Temperature Increase Range: 100° C. to 320° C. (held at 320° C.)

Rate of Temperature Increase: 20° C./min.

<Method of Measuring Storage Elastic Modulus (G')>

A storage elastic modulus (G') was measured under conditions shown below, with a viscoelasticity measurement apparatus (ARES) manufactured by TA Instruments, Japan.

Jig used for measurement: 8-mm parallel plate

Frequency: 1 Hz

Distortion factor: 5%

Measurement start temperature: 40° C.

Rate of temperature increase: 5° C./min.

<Method of Measuring Number Average Molecular Weight and Mass Average Molecular Weight of Resin>

A number average molecular weight and a mass average molecular weight of a resin (excluding a polyurethane resin and including a crystalline urethane-modified polyester resin) were measured with gel permeation chromatography (GPC) under conditions below, with respect to solubles in tetrahydrofuran (THF).

Measurement apparatus: "HLC-8120" manufactured by Tosoh Corporation

Column: "TSKgel GMHXL" (two) manufactured by Tosoh Corporation and "TSKgel Multipore HXL-M" (one) manufactured by Tosoh Corporation Sample solution: 0.25 mass % of THF solution Amount of injection of sample solution into column: 100 μl Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

A number average molecular weight and a mass average molecular weight of a polyurethane resin were measured with the use of GPC under conditions below.

Measurement apparatus: "HLC-8220GPC" manufactured by Tosoh Corporation

Column: "Guardcolumn α" (one) and "TSKgel α-M" (one)

Sample solution: 0.125 mass % of dimethylformamide solution

Amount of injection of dimethylformamide solution into column: 100 μl

Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

<Method of Measuring Glass Transition Point of Resin>

A glass transition point of a resin can be measured with the use of a DSC method or a flow tester. A glass transition point of a resin (including a shell resin) herein was measured with a DSC apparatus (DSC20 manufactured by Seiko Instruments, Inc.) in compliance with a method defined under ASTM D3418-82.

A liquid developer according to the present invention will be described below with reference to the drawings. It is noted that the same reference numerals in the drawings of the present invention refer to the same or corresponding elements. Relation of such a dimension as a length, a width, a thickness, or a depth is modified as appropriate for clarity and brevity of the drawings and does not represent actual dimensional relation.

<Liquid Developer>

A liquid developer according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper, and it includes an insulating liquid and toner particles dispersed in the insulating liquid. Preferably, the liquid developer according to the present embodiment contains, for example, 10 to 50 mass % of toner particles and 50 to 90 mass % of the insulating liquid. The liquid developer according to the present embodiment contains more preferably 15 to 45 mass % of toner particles and further preferably 20 to 40 mass % of toner particles. The liquid developer according to the present embodiment may contain any component other than the toner particles and the insulating liquid, and any component other than the toner particles and the insulating liquid may be, for example, a filler, an antistatic agent, a release agent, a charge control agent, a UV absorber, an antioxidant, an antiblocking agent, a heat-resistant stabilization agent, a fire retardant, a thickener, or a dispersant.

The toner particles in the present embodiment contain a core resin, a shell resin different from the core resin, and a coloring agent. The core resin contains a crystalline urethane-modified polyester resin. Thus, when a temperature of the liquid developer is equal to or higher than a softening temperature of the crystalline urethane-modified polyester resin, a storage elastic modulus of a solid content of the liquid developer corresponding to a portion of the liquid developer excluding the insulating liquid (hereinafter simply denoted as a "solid content of the liquid developer") abruptly lowers. Therefore, if toner particles are fixed at a temperature higher than the softening temperature of the crystalline urethane-modified polyester resin, molten toner particles tend to spread over such a recording medium as paper, and hence an image excellent in a degree of gloss is formed on the recording medium. Furthermore, since the softening temperature of the crystalline resin is lower than the softening temperature of a non-crystalline resin, toner particles can be fixed at a low temperature. In addition, since an excessively low storage elastic modulus at a high temperature of the solid content of the liquid developer can be prevented, occurrence of high-temperature offset can be prevented. Since a softening start temperature of the solid content of the liquid developer can be optimized, occurrence of document offset can also be prevented. The liquid developer according to the present embodiment will be described hereinafter with reference to FIGS. 1 and 2.

FIG. 1 is a graph schematically showing temperature dependency of a storage elastic modulus (G') of a solid content of a liquid developer according to the present embodiment.

In connection with the liquid developer according to the present embodiment, the solid content of the liquid developer has a storage elastic modulus at 80° C., not lower than $1\times10^4$ Pa and not higher than $5\times10^6$ Pa. If the solid content of the liquid developer has a storage elastic modulus at 80° C. (G'(80)) lower than $1\times10^4$ Pa, toner particles tend to be molten during fixation, which leads to occurrence of high-temperature offset. On the other hand, if the solid content of the liquid developer has a storage elastic modulus at 80° C. (G'(80)) exceeding $5\times10^6$ Pa, toner particles are less likely to be molten during fixation, which leads to lowering in fixability of the toner particles and lowering in a degree of gloss of an image formed on such a recording medium as paper. When the solid content of the liquid developer has a storage elastic modulus at 80° C. (G'(80)), not lower than $1\times10^4$ Pa and not higher than $5\times10^6$ Pa, however, toner particles can be prevented from excessively being molten during fixation and hence occurrence of high-temperature offset can be prevented. In addition, since toner particles can also be prevented from being less likely to be molten during fixation, fixability of the toner particles can be ensured and glossiness of an image can be ensured. Namely, when the solid content of the liquid developer has a storage elastic modulus at 80° C. (G'(80)), not lower than $1\times10^4$ Pa and not higher than $5\times10^6$ Pa, occurrence of high-temperature offset can be prevented while fixability of toner particles and glossiness of an image are ensured. The solid content of the liquid developer preferably has a storage elastic modulus at 80° C. (G'(80)), not lower than $5\times10^4$ Pa and not higher than $1\times10^6$ Pa. Thus, fixability of toner particles and glossiness of an image are improved and occurrence of high-temperature offset can further be prevented.

In connection with the liquid developer according to the present embodiment, a lowest temperature at the time when an absolute value of an amount of change in a logarithmic value (log(G')) of the storage elastic modulus (G') of the solid content of the liquid developer with respect to a temperature T (° C.) ($|\Delta \log(G')/\Delta T|$) (hereinafter denoted as a "softening start temperature of the solid content of the liquid developer") satisfies Equation (1) below is not lower than 45° C.:

$$|\Delta \log(G')/\Delta T|>0.1 \qquad \text{Equation (1).}$$

When the softening start temperature of the solid content of the liquid developer is equal to or higher than 45° C., occurrence of document offset can be prevented. When a printed matter is stored in a high-temperature condition or a pressurized condition, a temperature of the printed matter may increase up to around 45° C. If a softening start temperature of the solid content of the liquid developer is equal to or higher than 45° C., however, toner particles can be prevented from being molten during storage of a printed matter. Preferably, a softening start temperature of the solid content of the liquid developer is not lower than 45° C. and not higher than 70° C. Thus, occurrence of document offset can further be prevented. In addition, even during fixation at a low temperature, toner particles can be molten during fixation, and therefore a liquid developer better in low-temperature fixability can be provided. Further preferably, a softening start temperature of the solid content of the liquid developer is not lower than 45° C. and not higher than 60° C. In FIG. 1, a region A where the graph is flat does not satisfy Equation (1) above and a region B where the graph abruptly changes satisfies Equation (1) above.

Figure 2A:
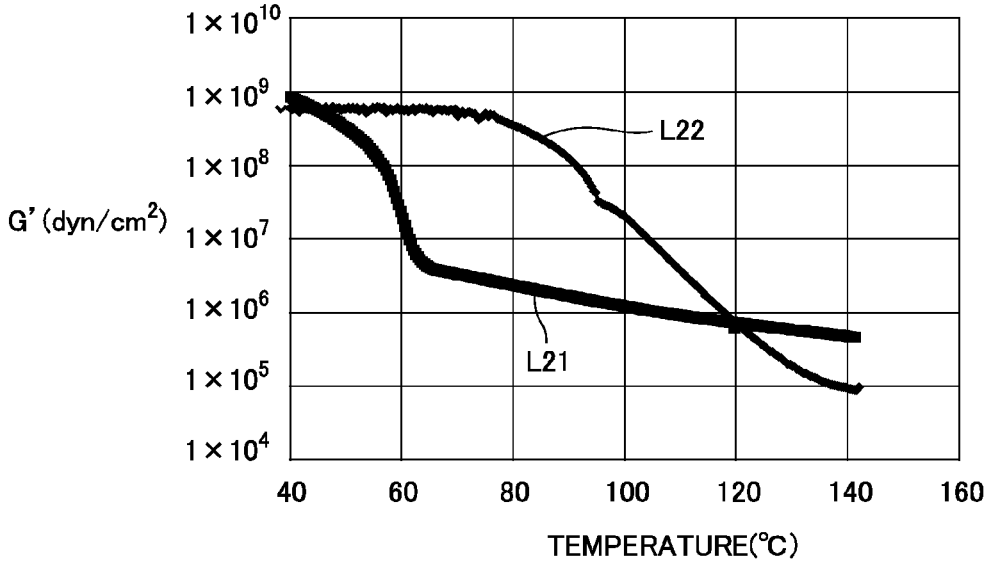
FIG. 2A is a graph showing a result of measurement of temperature dependency of viscoelasticity of a crystalline resin and a non-crystalline resin.
Figure 2B:
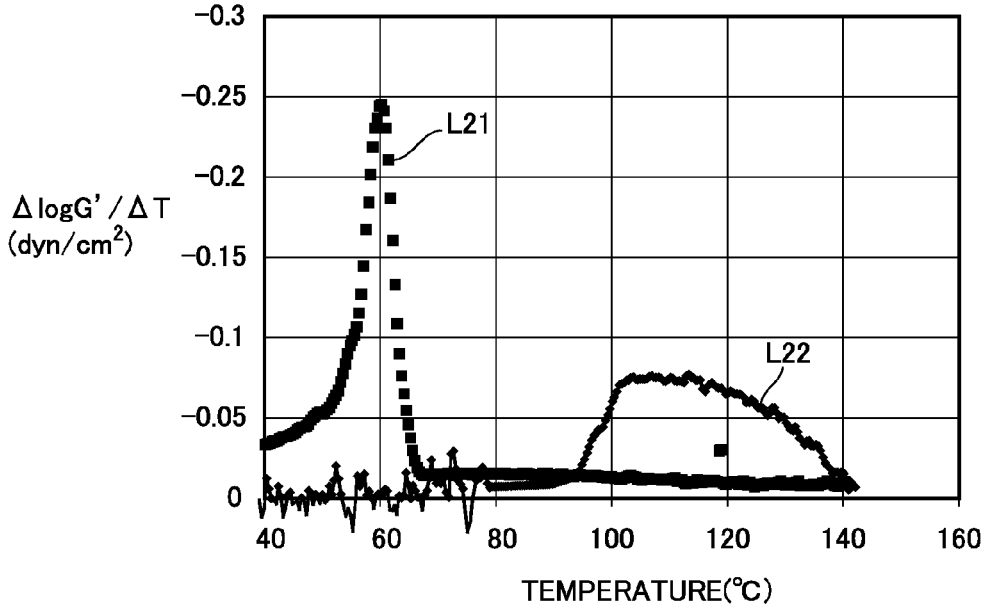
FIG. 2B is a graph showing a result of finding temperature dependency of $|\Delta \log(G')/\Delta T|$ from FIG. 2A.

Temperature dependency of a storage elastic modulus (G') of a crystalline urethane-modified polyester resin and a non-crystalline urethane-modified polyester resin was measured. FIG. 2A is a graph showing a result thereof and FIG. 2B is a graph showing a result of finding temperature dependency of $|\Delta \log(G')/\Delta T|$ from FIG. 2A. In FIGS. 2A and 2B, L21 represents a result of the crystalline urethane-modified polyester resin and L22 represents a result of the non-crystalline urethane-modified polyester resin.

In connection with the crystalline urethane-modified polyester resin, a peak derived from softening of the crystalline resin was clearly observed in FIG. 2B and a softening start temperature of the solid content of the liquid developer could be found as 56° C. A storage elastic modulus at 80° C. was approximately $2\times10^6$ (dyn/cm$^2$). On the other hand, in connection with the non-crystalline urethane-modified polyester resin, in FIG. 2B, a peak derived from softening of the non-crystalline resin could not be observed. A storage elastic modulus at 80° C. was as high as approximately $1\times10^8$ (dyn/cm$^2$), and it is considered that melting of toner particles has not yet started at 80° C. It is noted that 1 Pa=10 dyn/cm$^2$.

In the present embodiment, the crystalline urethane-modified polyester resin preferably satisfies Equations (2) to (4) below.

$$y\leq-0.0002x+11 \quad \text{Equation (2)}$$

$$10000\leq x\leq50000 \quad \text{Equation (3)}$$

$$1\leq y\leq7 \quad \text{Equation (4)}$$

When a number average molecular weight x of the crystalline urethane-modified polyester resin is smaller than 10000, toner particles tend to be molten during fixation. Therefore, it may be difficult to achieve a storage elastic modulus at 80° C. (G'(80)) of the solid content of liquid developer, which is not lower than $1\times10^4$ Pa, and high-temperature offset may occur. On the other hand, when a number average molecular weight of the crystalline urethane-modified polyester resin exceeds 50000, toner particles are less likely to be molten during fixation. Therefore, it may be difficult to achieve a storage elastic modulus at 80° C. (G'(80)) of the solid content of the liquid developer, which is not higher than $5\times10^6$ Pa, and fixation strength may lower. When a number average molecular weight of the crystalline urethane-modified polyester resin is not smaller than 10000 and not greater than 50000, occurrence of high-temperature offset can be prevented while fixation strength of toner particles is ensured.

As a result of dedicated studies conducted by the present inventors, it has been found that occurrence of document offset can be prevented when a concentration of a urethane group y in the crystalline urethane-modified polyester resin is low. The reason is because, when a concentration of a urethane group y in the crystalline urethane-modified polyester resin is low, a crystal structure thereof is robust and a softening start temperature of the solid content of the liquid developer becomes high.

It has also been found, however, that high-temperature offset may occur when a concentration of a urethane group y in the crystalline urethane-modified polyester resin is lower than 1 mass %. The reason may be as follows. A urethane group is called a hard segment and it has been said to be effective for maintaining elasticity. Therefore, if a concentration of a urethane group y in the crystalline urethane-modified polyester resin is too low, it may be difficult to achieve a storage elastic modulus at 80° C. (G'(80)) of the solid content of the liquid developer, which is not lower than $1\times10^4$ Pa.

On the other hand, for a reason in terms of manufacturing of a polyester resin before urethane modification, a concentration of a urethane group y in the crystalline urethane-modified polyester resin has the upper limit. Namely, if a molecular weight of the polyester resin before urethane modification is made smaller, a concentration of a urethane group y can be raised without change in a molecular weight of the crystalline urethane-modified polyester resin. In manufacturing of the polyester resin before urethane modification, however, approximately 1000 is the limit of the molecular weight of the polyester resin before urethane modification. In other words, a concentration of a urethane group y in the crystalline urethane-modified polyester resin is preferably not higher than 7 mass %.

As a result of further dedicated studies conducted by the present inventors, it has been found that, when a concentration of a urethane group y in the crystalline urethane-modified polyester resin is the same, a softening start temperature of the solid content of the liquid developer is higher as a number average molecular weight x of the crystalline urethane-modified polyester resin is smaller. The reason may be as follows. When a concentration of a urethane group y in the crystalline urethane-modified polyester resin is the same, a molecular chain is shortened as the number average molecular weight x of the crystalline urethane-modified polyester resin is smaller and a crystal structure of the crystalline urethane-modified polyester resin becomes robust. Consequently, that crystal structure is less likely to collapse even at a high temperature.

Summarizing the above, the present inventors have found that a softening start temperature of the solid content of the liquid developer is higher as a concentration of a urethane group y in the crystalline urethane-modified polyester resin is lower, and also found that high-temperature offset occurs when a concentration of a urethane group y in the crystalline urethane-modified polyester resin is lower than 1 mass %. In addition, the present inventors have found that, when a concentration of a urethane group y in the crystalline urethane-modified polyester resin is the same, a softening start temperature of the solid content of the liquid developer is higher as a number average molecular weight x of the crystalline urethane-modified polyester resin is smaller. Then, the present inventors have found that, in order to provide a liquid developer excellent in low-temperature fixability, with which occurrence of high-temperature offset and document offset is prevented while moderate gloss and fixation strength are ensured, Equations (2) to (4) above are preferably satisfied.

In the liquid developer according to the present embodiment, a shell resin has a glass transition point preferably not lower than 50° C. When a printed matter is stored in a high temperature condition or a pressurized condition, a temperature of the printed matter may increase up to around 45° C. Therefore, if the shell resin has a glass transition point not lower than 50° C., toner particles can further be prevented from being molten during storage of a printed matter. Therefore, occurrence of document offset can further be prevented. The shell resin has a glass transition point more preferably not lower than 50° C. and not higher than 70° C. Thus, occurrence of document offset can further be prevented. In addition, even during fixation at a low temperature, toner particles can be molten during fixation, and therefore a liquid developer better in low-temperature fixability can be provided. Further preferably, the shell resin has a glass transition point not lower than 50° C. and not higher than 65° C.

In the liquid developer according to the present embodiment, a solid content of the liquid developer has a storage elastic modulus at 80° C., not lower than $1\times10^4$ Pa and not higher than $5\times10^6$ Pa. The toner particles contain a core resin and a shell resin, the core resin has a softening start temperature not lower than 45° C., and the shell resin has a glass transition point not lower than 50° C. Therefore, the shell resin is harder and lower in meltability than the core resin. Therefore, the shell resin advantageously acts in suppression of occurrence of high-temperature offset and also in suppression of occurrence of document offset.

Toner particles, a core resin, a shell resin, and a coloring agent contained in the toner particles, and a material for a liquid developer will specifically be shown below.

<Toner Particles>

A median diameter D50 found through measurement of particle size distribution of toner particles in the present embodiment based on volume (hereinafter denoted as "median diameter D50 of toner particles") is preferably not smaller than 0.5 μm and not greater than 5.0 μm. This particle size is smaller than a particle size of toner particles contained in a dry developer which has conventionally been used and represents one of the features of the present invention. If median diameter D50 of toner particles is smaller than 0.5 μm, toner particles have too small a particle size and hence mobility of toner particles in electric field may become poor, which may lead to lowering in development performance. If median diameter D50 of toner particles exceeds 5.0 μm, uniformity in particle size of toner particles may be lowered, which may lead to lowering in image quality. Median diameter D50 of toner particles can be measured, for example, with a flow particle image analyzer (FPIA-3000S manufactured by Sysmex Corporation). Since this analyzer can use a solvent as it is as a dispersion medium, this analyzer can measure a state of toner particles in a state closer to an actually dispersed state, as compared with a system in which measurement is conducted in a water system.

Average circularity of toner particles is preferably not lower than 0.85 and not higher than 0.96. Circularity of toner particles is represented as a value obtained by calculating (a circumferential length of a circle equal in area to a projection area of toner particles)÷(a circumferential length of sensed toner particles) and it is found through a method the same as the method of measuring median diameter D50 of toner particles.

Toner particles in the present embodiment contain a core resin and a shell resin different from the core resin. Toner particles in the present embodiment preferably have such a core-shell structure (Japanese Laid-Open Patent Publication No. 2009-096994) that shell particles containing the shell resin adhere to or cover surfaces of the core particles containing the core resin.

A mass ratio between the shell particles and the core particles (shell particles:core particles) is preferably from 1:99 to 70:30, and from a point of view of uniformity in particle size of toner particles, heat-resistance stability of the liquid developer, and the like, it is more preferably from 2:98 to 50:50 and further preferably from 3:97 to 35:65. In other words, the resin is preferably composed of 1 to 70 mass % (more preferably 5 to 50 mass % and further preferably 10 to 35 mass %) of the shell particles in a film shape and 30 to 99 mass % (more preferably 50 to 95 mass % and further preferably 65 to 90 mass %) of the core particles. When a content (a mass ratio) of the shell particles is too low, blocking resistance of the toner particles may lower. When a content (a mass ratio) of the core particles is too high, uniformity in particle size of the toner particles may lower.

<Shell Resin>

Preferably, the shell resin is a resin different from the core resin shown below, and it is a resin having an SP value between an SP value of the core resin and an SP value of the insulating liquid. For example, the SP value is preferably from 7 to 18 $(cal/cm^3)^{1/2}$, more preferably from 8 to 14 $(cal/cm^3)^{1/2}$, and further preferably from 8 to 12 $(cal/cm^3)^{1/2}$. Further preferably, the shell resin has a glass transition point not lower than 50° C. When the shell resin has a glass transition point not lower than 50° C., occurrence of document offset can further be prevented. A shell resin having such characteristics is not particularly limited. A vinyl resin, a polyurethane resin, an epoxy resin, a polyamide resin, a polyimide resin, a silicon resin, a phenol resin, a melamine resin, a urea resin, an aniline resin, an ionomer resin, or a polycarbonate resin is preferably employed, and a vinyl resin is more preferably employed.

The vinyl resin may be a homopolymer obtained by homopolymerizing a monomer having polymeric double bond or a copolymer obtained by copolymerizing two or more types of monomers having polymeric double bond. A monomer having polymeric double bond is, for example, (1) to (9) below.

(1) Hydrocarbon Having Polymeric Double Bond

Hydrocarbon having polymeric double bond is preferably, for example, aliphatic hydrocarbon having polymeric double bond shown in (1-1) below, aromatic hydrocarbon having polymeric double bond shown in (1-2) below, or the like.

(1-1) Aliphatic Hydrocarbon Having Polymeric Double Bond

Aliphatic hydrocarbon having polymeric double bond is preferably, for example, chain hydrocarbon having polymeric double bond shown in (1-1-1) below, cyclic hydrocarbon having polymeric double bond shown in (1-1-2) below, or the like.

(1-1-1) Chain Hydrocarbon Having Polymeric Double Bond

Chain hydrocarbon having polymeric double bond is preferably, for example, alkene having a carbon number from 2 to 30 (such as ethylene, propylene, butene, isobutylene, pentene, heptene, diisobutylene, octene, dodecene, or octadecene); alkadiene having a carbon number from 4 to 30 (such as butadiene, isoprene, 1,4-pentadiene, 1,5-hexadiene, or 1,7-octadiene), or the like.

(1-1-2) Cyclic Hydrocarbon Having Polymeric Double Bond

Cyclic hydrocarbon having polymeric double bond is preferably, for example, mono- or di-cycloalkene having a carbon number from 6 to 30 (such as cyclohexene, vinyl cyclohexane, or ethylidene bicycloheptane); mono- or di-cycloalkadiene having a carbon number from 5 to 30 (such as cyclopentadiene or dicyclopentadiene); or the like.

(1-2) Aromatic Hydrocarbon Having Polymeric Double Bond

Aromatic hydrocarbon having polymeric double bond is preferably, for example, styrene; hydrocarbyl (such as alkyl, cycloalkyl, aralkyl, and/or alkenyl having a carbon number from 1 to 30) substitute of styrene (such as α-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene); vinyl naphthalene; or the like.

(2) Monomer Having Carboxyl Group and Polymeric Double Bond and Salt Thereof

A monomer having a carboxyl group and polymeric double bond is preferably, for example, unsaturated monocarboxylic acid having a carbon number from 3 to 15 [such as (meth) acrylic acid, crotonic acid, isocrotonic acid, or cinnamic acid]; unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid]; monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester); or the like. "(Meth)acrylic acid" herein means acrylic acid and/or methacrylic acid.

Salt of the monomer above is preferably, for example, alkali metal salt (such as sodium salt or potassium salt), alkaline earth metal salt (such as calcium salt or magnesium salt), ammonium salt, amine salt, and quaternary ammonium salt, and the like.

Amine salt is not particularly limited so long as it is an amine compound. Amine salt is preferably, for example, primary amine salt (such as ethylamine salt, butylamine salt, or octylamine salt); secondary amine salt (such as diethylamine salt or dibutylamine salt); tertiary amine salt (such as triethylamine salt or tributylamine salt); or the like.

Quaternary ammonium salt is preferably, for example, tetraethyl ammonium salt, triethyl lauryl ammonium salt, tetrabutyl ammonium salt, and tributyl lauryl ammonium salt, and the like.

Salt of the monomer having a carboxyl group and polymeric double bond is preferably, for example, sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, and aluminum acrylate, and the like.

(3) Monomer Having Sulfo Group and Polymeric Double Bond and Salt Thereof

A monomer having a sulfo group and polymeric double bond is preferably, for example, vinyl sulfonic acid, α-methylstyrene sulfonic acid, sulfopropyl (meth)acrylate, or 2-(meth)acryloylamino-2,2-dimethylethane sulfonic acid. Salt of a monomer having a sulfo group and polymeric double bond is preferably, for example, salts listed as the "salt of the monomer above" in "(2) Monomer Having Carboxyl Group and Polymeric Double Bond" above.

(4) Monomer Having Phosphono Group and Polymeric Double Bond and Salt Thereof

A monomer having a phosphono group and polymeric double bond is preferably, for example, 2-hydroxyethyl (meth)acryloyl phosphate or 2-acryloyloxy ethyl phosphonic acid. Salt of the monomer having a phosphono group and polymeric double bond is preferably, for example, salts listed as the "salt of the monomer above" in "(2) Monomer Having Carboxyl Group and Polymeric Double Bond" above.

(5) Monomer Having Hydroxyl Group and Polymeric Double Bond

A monomer having a hydroxyl group and polymeric double bond is preferably, for example, hydroxystyrene, N-methylol (meth)acrylamide, or hydroxyethyl (meth)acrylate.

(6) Nitrogen-Containing Monomer Having Polymeric Double Bond

A nitrogen-containing monomer having polymeric double bond is, for example, a monomer shown in (6-1) to (6-4) below.

(6-1) Monomer Having Amino Group and Polymeric Double Bond

A monomer having an amino group and polymeric double bond is preferably, for example, aminoethyl (meth)acrylate, dimethylaminoethyl (meth)acrylate, diethylaminoethyl (meth)acrylate, t-butylaminoethyl (meth)acrylate, N-aminoethyl (meth)acrylamide, (meth)allyl amine, morpholinoethyl (meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, aminomercaptothiazole, or the like. The monomer having an amino group and polymeric double bond may be the salts of the monomer listed above. The salts of the monomer listed above are preferably, for example, salts listed as the "salt of the monomer above" in "(2) Monomer Having Carboxyl Group and Polymeric Double Bond" above.

(6-2) Monomer Having Amide Group and Polymeric Double Bond

A monomer having an amide group and polymeric double bond is preferably, for example, (meth)acrylamide, N-methyl (meth)acrylamide, N-butyl (meth)acrylamide, diacetone acrylamide, N-methylol (meth)acrylamide, N,N'-methylene-bis(meth)acrylamide, cinnamic acid amide, N,N-dimethyl (meth)acrylamide, N,N-dibenzyl (meth)acrylamide, (meth) acrylformamide, N-methyl-N-vinylacetamide, and N-vinylpyrrolidone, and the like.

(6-3) Monomer Having Carbon Number from 3 to 10 and Having Nitrile Group and Polymeric Double Bond A monomer having a carbon number from 3 to 10 and having a nitrile group and polymeric double bond is preferably, for example, (meth)acrylonitrile, cyanostyrene, and cyanoacrylate, and the like.

(6-4) Monomer Having Carbon Number from 8 to 12 and Having Nitro Group and Polymeric Double Bond A monomer having a carbon number from 8 to 12 and having a nitro group and polymeric double bond is preferably, for example, nitrostyrene or the like.

(7) Monomer Having Carbon Number from 6 to 18 and Having Epoxy Group and Polymeric Double Bond A monomer having a carbon number from 6 to 18 and having an epoxy group and polymeric double bond is preferably, for example, glycidyl (meth)acrylate or the like.

(8) Monomer Having Carbon Number from 2 to 16 and Having Halogen Element and Polymeric Double Bond A monomer having a carbon number from 2 to 16 and having a halogen element and polymeric double bond is preferably, for example, vinyl chloride, vinyl bromide, vinylidene chloride, allyl chloride, chlorostyrene, bromostyrene, dichlorostyrene, chloromethylstyrene, tetrafluorostyrene, and chloroprene, and the like.

(9) Ester Having Carbon Number from 4 to 16 and Having Polymeric Double Bond

An ester having a carbon number from 4 to 16 and having polymeric double bond is preferably, for example, vinyl acetate; vinyl propionate; vinyl butyrate; diallyl phthalate; diallyl adipate; isopropenyl acetate; vinyl methacrylate; methyl-4-vinyl benzoate; cyclohexyl methacrylate; benzyl methacrylate; phenyl (meth)acrylate; vinyl methoxy acetate; vinyl benzoate; ethyl-α-ethoxy acrylate; alkyl (meth)acrylate having an alkyl group having a carbon number from 1 to 11 [such as methyl (meth)acrylate, ethyl (meth)acrylate, propyl (meth)acrylate, butyl (meth)acrylate, or 2-ethylhexyl (meth) acrylate]; dialkyl fumarate (two alkyl groups being straight-chain alkyl groups, branched alkyl groups, or alicyclic alkyl groups, having a carbon number from 2 to 8); dialkyl maleate (two alkyl groups being straight-chain alkyl groups, branched alkyl groups, or alicyclic alkyl groups, having a carbon number from 2 to 8); poly(meth)allyloxy alkanes (such as diallyloxyethane, triallyloxyethane, tetraallyloxyethane, tetraallyloxypropane, tetraallyloxybutane, or tetramethallyloxyethane); a monomer having a polyalkylene glycol chain and polymeric double bond [such as polyethylene glycol (Mn=300) mono(meth)acrylate, polypropylene glycol (Mn=500) mono(meth)acrylate, a 10-mole adduct (meth)acrylate of ethylene oxide (hereinafter "ethylene oxide" being abbreviated as "EO") to methyl alcohol, or a 30-mole adduct (meth)acrylate of EO to lauryl alcohol]; poly (meth)acrylates {such as poly(meth)acrylate of polyhydric alcohols [such as ethylene glycol di(meth)acrylate, propylene glycol di(meth)acrylate, neopentyl glycol di(meth)acrylate, trimethylol propane tri(meth)acrylate, or polyethylene glycol di(meth)acrylate]}; or the like.

A specific example of a vinyl resin is preferably, for example, a styrene-(meth)acrylic acid ester copolymer, a styrene-butadiene copolymer, a (meth)acrylic acid-(meth) acrylic acid ester copolymer, a styrene-acrylonitrile copolymer, a styrene-maleic acid (maleic anhydride) copolymer, a styrene-(meth)acrylic acid copolymer, a styrene-(meth) acrylic acid-divinylbenzene copolymer, a styrene-styrene sulfonic acid-(meth)acrylic acid ester copolymer, or the like.

The vinyl resin may be a homopolymer or a copolymer of a monomer having polymeric double bond in (1) to (9) above, or it may be a polymerized product of a monomer having polymeric double bond in (1) to (9) above and a monomer (m) having a molecular chain (k) and having polymeric double bond. A difference in SP value between the molecular chain (k) in the monomer (m) and the insulating liquid is preferably 2 or smaller. The "SP value" herein is a numeric value calculated with a Fedors' method [Polym. Eng. Sci. 14(2) 152, (1974)].

Though the monomer (m) having the molecular chain (k) and polymeric double bond is not particularly limited, it is preferably, for example, monomers (m1) to (m3) below. Two or more of the monomers (m1) to (m3) may be used together as the monomer (m).

The monomer (m1) having straight-chain hydrocarbon chain having carbon number from 12 to 27 (preferably from 16 to 25) and polymeric double bond is preferably, for example, mono-straight-chain alkyl (a carbon number of alkyl being from 12 to 27) ester of unsaturated monocarboxylic acid, mono-straight-chain alkyl (a carbon number of alkyl being from 12 to 27) ester of unsaturated dicarboxylic acid, or the like. Unsaturated monocarboxylic acid and unsaturated dicarboxylic acid above are preferably, for example, a carboxyl group containing vinyl monomer having a carbon number from 3 to 24 such as (meth)acrylic acid, maleic acid, fumaric acid, crotonic acid, itaconic acid, and citraconic acid. A specific example of the monomer (m1) is, for example, dodecyl (meth)acrylate, stearyl (meth)acrylate, behenyl (meth)acrylate, hexadecyl (meth)acrylate, heptadecyl (meth) acrylate, eicosyl (meth)acrylate, or the like.

The monomer (m2) having branched hydrocarbon chain having carbon number from 12 to 27 (preferably from 16 to 25) and polymeric double bond is preferably, for example, branched alkyl (a carbon number of alkyl being from 12 to 27) ester of unsaturated monocarboxylic acid, mono-branched alkyl (a carbon number of alkyl being from 12 to 27) ester of unsaturated dicarboxylic acid, or the like. Unsaturated monocarboxylic acid and unsaturated dicarboxylic acid are preferably, for example, as those the same as listed as specific examples of unsaturated monocarboxylic acid or unsaturated dicarboxylic acid with regard to the monomer (m1). A specific example of the monomer (m2) is, preferably, for example, 2-decyltetradecyl (meth)acrylate or the like.

The monomer (m) having a polymeric double bond having the molecular chain (k) may be the monomer (m3) having fluoro-alkyl chain having a carbon number from 4 to 20 and polymeric double bond.

A shell resin has a melting point preferably from 0 to 220° C., more preferably from 30 to 200° C., and further preferably from 45 to 80° C. From a point of view of particle size distribution of toner particles, as well as powder fluidity, heat-resistant storage stability, and resistance to stress of the liquid developer, the shell resin has a melting point preferably not lower than a temperature during manufacturing of the liquid developer. If a melting point of the shell resin is lower than a temperature during manufacturing of the liquid developer, it may be difficult to prevent toner particles from uniting with each other and it may be difficult to prevent the toner particles from breaking. In addition, it may be difficult to achieve a narrow width of distribution in particle size distribution of the toner particles. In other words, variation in particle size of toner particles may be great. A melting point herein was measured with a DSC apparatus (DSC20 manufactured by Seiko Instruments, Inc.) in compliance with a method defined under ASTM D3418-82.

A number average molecular weight of the shell resin is preferably from 100 to 5000000, more preferably from 200 to 5000000, and further preferably from 500 to 500000.

Shell particles contain the shell resin and can be manufactured, for example, with a method shown in any of [1] to [7] below. From a point of view of ease in manufacturing of the shell particles, manufacturing with a method shown in [4], [6], or [7] below is preferred, and manufacturing with a method shown in [6] or [7] below is more preferred.

[1]: The shell resin is crushed with a dry method with the use of a known dry type crusher such as a jet mill.

[2]: Powders of the shell resin are dispersed in an organic solvent, and the resultant product is crushed with a wet method with the use of a known wet type disperser such as a bead mill or a roll mill.

[3]: A solution of the shell resin is sprayed and dried with the use of a spray dryer or the like.

[4]: A poor solvent is added to a solution of the shell resin or the solution is cooled, to thereby supersaturate and precipitate the shell resin.

[5]: A solution of the shell resin is dispersed in water or an organic solvent.

[6]: A precursor of the shell resin is polymerized in water with an emulsion polymerization method, a soap-free emulsion polymerization method, a seed polymerization method, a suspension polymerization method, or the like.

[7]: A precursor of the shell resin is polymerized in an organic solvent through dispersion polymerization or the like.

A volume average particle size of the shell particles can be adjusted as appropriate in order to achieve a particle size suited to obtain toner particles having a desired particle size. A volume average particle size of the shell particles is preferably from 0.0005 to 3 μm. The upper limit of the volume average particle size of the shell particles is more preferably 2 μm and further preferably 1 μm. The lower limit of the volume average particle size of the shell particles is more preferably 0.01 μm, further preferably 0.02 μm, and most preferably 0.04 μm. For example, in a case where toner particles having a volume average particle size of 1 μm are desirably obtained, the shell particles have a volume average particle size preferably from 0.0005 to 0.3 μm and more preferably from 0.001 to 0.2 μm. For example, in a case where toner particles having a volume average particle size of 10 μm are desirably obtained, the shell particles have a volume average particle size preferably from 0.005 to 3 μm and more preferably from 0.05 to 2 μm.

The volume average particle size of the shell particles can be measured by using, for example, a laser particle size distribution analyzer (such as "LA-920" manufactured by Horiba, Ltd. or "Multisizer III" manufactured by Beckman Coulter or "ELS-800" (manufactured by Otsuka Electronics Co., Ltd.) using a laser Doppler method as an optical system or the like). If different measurement apparatuses measure a volume average particle size of the shell particles and there is variation in measurement values, a measurement value obtained by "ELS-800" is adopted.

<Core Resin>

The core resin contains a crystalline urethane-modified polyester resin, and includes, for example, the crystalline urethane-modified polyester resin preferably by not lower than 80 mass % and not higher than 95 mass % and more preferably by not lower than 85 mass %, and further preferably it consists of the urethane-modified polyester resin. For example, by measuring an NMR spectrum, an IR spectrum, a GC-MS spectrum, or viscoelasticity of the core resin, whether or not the core resin contains the urethane-modified polyester resin can be examined. For example, by measuring an NMR spectrum or a GC-MS spectrum of the core resin, a content of the urethane-modified polyester resin in the core resin can be measured.

A urethane-modified polyester resin is obtained, for example, by polymerizing polyol (an alcohol component) with polycarboxylic acid (an acid component), acid anhydride of polycarboxylic acid (an acid component), or ester of lower alkyl of polycarboxylic acid (an acid component) to thereby obtain a polycondensed product (a polyester resin) and then increasing a chain length of the polyester resin with di(tri)isocyanate. Ester of lower alkyl means ester having a carbon number of an alkyl group from 1 to 4. A known polycondensation catalyst can be used for polycondensation reaction. A ratio between polyol and polycarboxylic acid is not particularly limited. A ratio between polyol and polycarboxylic acid should only be set such that an equivalent ratio between a hydroxyl group [OH] and a carboxyl group [COOH] ([OH]/[COOH]) is set preferably to 2/1 to 1/5, more preferably to 1.5/1 to 1/4, and further preferably to 1.3/1 to 1/3.

By selecting as appropriate an alcohol component or an acid component, the urethane-modified polyester resin will express crystallinity. A constitutional unit derived from the alcohol component is preferably derived from an aliphatic monomer, it more preferably has a straight chain alkyl skeleton having a carbon number not smaller than 4, and it is further preferably, for example, aliphatic diol. A constitutional unit derived from the acid component is preferably derived from an aliphatic monomer, it more preferably has a straight chain alkyl skeleton having a carbon number not smaller than 4, and it is further preferably, for example, aliphatic dicarboxylic acid. This is also the case with acid anhydride of polycarboxylic acid and ester of lower alkyl of polycarboxylic acid. Thus, since the urethane-modified polyester resin tends to be in a straight-chain form, the urethane-modified polyester resin tends to express crystallinity. If the urethane-modified polyester resin expresses crystallinity, the urethane-modified polyester resin may contain a constitutional unit derived from an aromatic monomer.

Aliphatic diol is one type of an aliphatic monomer, and ethylene glycol, 1,3-propylene glycol, 1,4-butanediol, 1,6-hexanediol, 1,9-nonanediol, 1,10-decanediol, or 1,12-dodecanediol can suitably be employed. Two or more of these can also be employed as mixed.

Aliphatic dicarboxylic acid is one type of an aliphatic monomer, and alkane dicarboxylic acid having a carbon number from 4 to 20 or alkane dicarboxylic acid having a carbon number from 4 to 36 can suitably be employed. For example, succinic acid, adipic acid, sebacic acid, dodecanedioic acid, maleic acid, or fumaric acid can suitably be employed as aliphatic dicarboxylic acid. Two or more of these can also be employed as mixed. Acid anhydride of polycarboxylic acid is more preferably acid anhydride of aliphatic dicarboxylic acid, and for example, acid anhydride of succinic acid, adipic acid, sebacic acid, maleic acid, or fumaric acid can suitably be employed as acid anhydride of aliphatic dicarboxylic acid. Two or more of these can also be employed as mixed. Ester of lower alkyl of polycarboxylic acid is more preferably ester of lower alkyl of aliphatic dicarboxylic acid, and for example, ester of lower alkyl of succinic acid, adipic acid, sebacic acid, maleic acid, or fumaric acid can suitably be employed as ester of lower alkyl of aliphatic dicarboxylic acid. Two or more of these can also be employed as mixed.

A compound used for urethane modification of a polyester resin is preferably a compound containing an isocyanate group, in which two or more isocyanate groups are more preferably contained in one molecule, and it may be chain aliphatic polyisocyanate or cyclic aliphatic polyisocyanate. Chain aliphatic polyisocyanate is preferably, for example, ethylene diisocyanate; tetramethylene diisocyanate; hexamethylene diisocyanate (hereinafter abbreviated as "HDI"); dodecamethylene diisocyanate; 1,6,11-undecane triisocyanate; 2,2,4-trimethyl hexamethylene diisocyanate; lysine diisocyanate; 2,6-diisocyanatomethyl caproate; bis(2-isocyanatoethyl) fumarate; bis(2-isocyanatoethyl) carbonate; 2-isocyanatoethyl-2,6-diisocyanatohexanoate; or two or more of these as used together. Cyclic aliphatic polyisocyanate is preferably, for example, isophoron diisocyanate (hereinafter abbreviated as "IPDI"); dicyclohexylmethane-4,4'-diisocyanate (hydrogenated MDI); cyclohexylene diisocyanate; methylcyclohexylene diisocyanate (hydrogenated TDI); bis(2-isocyanatoethyl)-4-cyclohexene-1,2-dicarboxylate; 2,5- or 2,6-norbornane diisocyanate; or two or more of these as used together. By preparing a liquid developer with the use of the urethane-modified polyester resin as the core resin, which is obtained from listed aliphatic diol, aliphatic dicarboxylic acid, acid anhydride of aliphatic dicarboxylic acid, and/or ester of lower alkyl of aliphatic dicarboxylic acid, and a compound containing an isocyanate group, a storage elastic modulus at 80° C. (G'(80)) of the solid content of the liquid developer is not lower than $1\times10^4$ Pa and not higher than $5\times10^6$ Pa and a softening start temperature of the solid content of the liquid developer is not lower than 45° C. The urethane-modified polyester resin obtained from aliphatic diol, aliphatic dicarboxylic acid, acid anhydride of aliphatic dicarboxylic acid, and/or ester of lower alkyl of aliphatic dicarboxylic acid, and a compound containing an isocyanate group listed above satisfies Equations (2) to (4) above.

Depending on applications of a liquid developer, a number average molecular weight, a melting point, Tg, and an SP value of the core resin are preferably adjusted as appropriate. For example, in a case that the liquid developer according to the present embodiment is used as a liquid developer used for electrophotography, electrostatic recording, or electrostatic printing, the core resin has a number average molecular weight preferably from 10000 to 50000, a melting point preferably from 30 to 80° C., and Tg preferably not lower than 40° C. and more preferably not higher than 80° C. When the core resin has Tg not higher than 80° C., fixation at a low temperature can be achieved. For example, by adjusting a ratio between an amount of an acid group and an amount of a hydroxyl group which are source materials of the polyester resin or a ratio between an amount of an isocyanate group and an amount of a hydroxyl group, a molecular weight of the core resin (specifically, a number average molecular weight x of the core resin or a concentration of a urethane group y in the core resin) can be adjusted.

<Coloring Agent>

A coloring agent in the present embodiment is preferably dispersed in a resin contained in toner particles, and a particle size thereof is preferably not larger than 0.3 μm. When a coloring agent has a particle size exceeding 0.3 μm, dispersion of the coloring agent becomes poor, which results in lowering in degree of gloss. Consequently, it may be difficult to realize a desired color.

Though a known pigment can be employed as a coloring agent without being particularly limited, from a point of view of cost, light resistance, coloring capability, and the like, pigments shown below are preferably employed. In terms of color construction, pigments shown below are normally categorized into a black pigment, a yellow pigment, a magenta pigment, and a cyan pigment, and colors (color images) other than black are basically toned by subtractive color mixture of a yellow pigment, a magenta pigment, and a cyan pigment.

A black pigment may be, for example, carbon black such as furnace black, channel black, acetylene black, thermal black, or lamp black, carbon black derived from biomass, or magnetic powders of magnetite or ferrite. Azine-based compound nigrosine which is a purple-black dye may be used alone or in combination. As nigrosine, one type or two types of materials selected from the group consisting of C. I. Solvent Black 7 or C. I. Solvent Black 5 can be employed.

A magenta pigment or a red pigment is preferably, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48; 1, C. I. Pigment Red 53; 1, C. I. Pigment Red 57; 1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, or C. I. Pigment Red 222.

An orange pigment or a yellow pigment is preferably, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, or C. I. Pigment Yellow 185.

A green pigment or a cyan pigment is preferably, for example, C. I. Pigment Blue 15, C. I. Pigment Blue 15; 2, C. I. Pigment Blue 15; 3, C. I. Pigment Blue 15; 4, C. I. Pigment Blue 16, C. I. Pigment Blue 60, C. I. Pigment Blue 62, C. I. Pigment Blue 66, or C. I. Pigment Green 7.

An amount of addition of a coloring agent is preferably not lower than 10 mass % and lower than 50 mass % and more preferably not lower than 13 mass % and lower than 35 mass %, with respect to the total solid content of the liquid developer. When an amount of addition of a coloring agent is lower than 10 mass % with respect to the total solid content of the liquid developer, sufficient coloring capability cannot be obtained in some cases. In addition, liquefaction of the resin cannot be prevented by addition of the coloring agent in some cases. Specifically, as a degree of crystallinity of the resin contained in the toner particles is higher, that resin is molten at a low temperature and tends to readily be liquefied. Addition of an appropriate amount of coloring agent, however, prevents liquefaction owing to a filler effect. When an amount of addition of the coloring agent exceeds 50 mass % with respect to the total solid content of the liquid developer, the filler effect above is excessive and it may be difficult to melt the resin. The liquid developer according to the present embodiment may contain only one type of the coloring agents above or may contain two or more types of the coloring agents above.

<Dispersant for Pigment>

A dispersant for pigment has a function to uniformly disperse a pigment in toner particles and it is preferably, for example, a basic dispersant. Here, the basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate obtained through filtration is measured with a pH meter (D-51 of Horiba, Ltd.), and a filtrate of which pH is higher than 7 is defined as a basic dispersant. It is noted that a filtrate obtained by filtration, of which pH is lower than 7, is referred to as an acid dispersant.

A type of such a basic dispersant is not particularly limited. For example, a compound (dispersant) having a functional group such as an amino group, an amide group, a pyrrolidone group, an imine group, or a urethane group in a molecule of the dispersant can be exemplified. It is noted that what is called a surfactant having a hydrophilic portion and a hydrophobic portion in a molecule normally falls under the dispersant, however, various compounds can be employed, so long as they have a function to disperse a pigment.

A commercially available product of such a basic dispersant is preferably, for example, "Ajisper PB-821" (trade name), "Ajisper PB-822" (trade name), or "Ajisper PB-881" (trade name), manufactured by Ajinomoto Fine-Techno Co., Inc., or "Solsperse 28000" (trade name), "Solsperse 32000" (trade name), "Solsperse 32500" (trade name), "Solsperse 35100" (trade name), or "Solsperse 37500" (trade name), manufactured by Japan Lubrizol Limited.

More preferably, a dispersant for pigment is not dissolved in an insulating liquid, and for example, "Ajisper PB-821" (trade name), "Ajisper PB-822" (trade name), or "Ajisper PB-881" (trade name), manufactured by Ajinomoto Fine-Techno Co., Inc. is more preferred. By using such a dispersant for pigment, it became easier to obtain toner particles having a desired shape, although a reason is not known.

Preferably 1 to 100 mass % and more preferably 1 to 40 mass % of such a dispersant for pigment is added to the pigment. When an amount of addition of the dispersant for pigment is lower than 1 mass %, dispersibility of the pigment may be insufficient, and hence necessary ID (image density) cannot be achieved in some cases. In addition, fixability of toner particles may be lowered. When an amount of addition of the dispersant for pigment exceeds 100 mass %, the dispersant for pigment in an amount more than necessary for dispersing the pigment is added. Therefore, the excessive dispersant for pigment may be dissolved in the insulating liquid, which adversely affects chargeability or fixability of toner particles. One type alone of such a dispersant for pigment may be used or two or more types may be mixed for use.

<Insulating Liquid>

The insulating liquid has a resistance value preferably to such an extent as not distorting an electrostatic latent image (approximately from $10^{11}$ to $10^{16}$ Ω·cm) and preferably it is, for example, a solvent having low odor and toxicity. From such a point of view, the insulating liquid is preferably aliphatic hydrocarbon, alicyclic hydrocarbon, aromatic hydrocarbon, halogenated hydrocarbon, or polysiloxane. In particular from a point of view of low odor and toxicity as well as low cost, the insulating liquid is preferably a normal paraffin based solvent or an isoparaffin based solvent, and preferably, for example, MORESCO WHITE (manufactured by MORESCO Corporation), ISOPAR M (manufactured by Exxon Mobil Corporation), SHELLSOL (manufactured by Showa Shell Sekiyu K. K.), IP Solvent 1620 (manufactured by Idemitsu Kosan Co., Ltd.), IP Solvent 2028 (manufactured by Idemitsu Kosan Co., Ltd.), or IP Solvent 2835 (manufactured by Idemitsu Kosan Co., Ltd.). Two or more types of these may be used as mixed.

<Method of Manufacturing Liquid Developer>

The liquid developer according to the present embodiment is preferably manufactured by dispersing toner particles in an insulating liquid. Toner particles are preferably manufactured in accordance with a method shown below.

<Method of Manufacturing Toner Particles>

Toner particles are preferably manufactured based on such a known technique as a granulation method. When toner particles are manufactured with the granulation method, toner particles having a small particle size, of which particle size distribution has a sharp peak, are obtained. Therefore, quality of an image can be high. In addition, printing cost per one copy can also be lowered. The granulation method is exemplified, for example, by a suspension polymerization method, an emulsion polymerization method, a fine particle aggregation method, a method of adding a poor solvent to a resin solution for precipitation, a spray drying method, or a method of forming a core-shell structure with two different types of resins.

Toner particles in the present embodiment are preferably manufactured with a method shown below. Initially, a core resin solution is obtained by dissolving a resin in a good solvent. Then, the core resin solution described above is mixed, together with an interfacial tension adjuster, in a poor solvent different in SP value from the good solvent, shear is provided, and thus a droplet is formed. Thereafter, by volatilizing the good solvent, core particles containing the core resin are obtained. In the present embodiment, fine particles composed of a shell resin are employed as an interfacial tension adjuster. Thus, since surfaces of the core particles containing the core resin can be coated with a film of fine particles composed of the shell resin, toner particles which can be dispersed in the insulating liquid in a stable manner can be formed. Use of a surfactant or a dispersant as an interfacial tension adjuster can bring about toner high in meltability. By varying how to provide shear, difference in interfacial tension, or an interfacial tension adjuster (a material for the shell resin), a particle size of toner particles or a shape of toner particles can be controlled.

<Image Formation Apparatus>

A construction of an apparatus for forming an image (image formation apparatus) which is formed by a liquid developer according to the present embodiment is not particularly limited. An image formation apparatus is preferably, for example, a monochrome image formation apparatus in which a monochrome liquid developer is primarily transferred from a photoconductor to an intermediate transfer element and thereafter secondarily transferred to paper (see FIG. 3), an image formation apparatus in which a monochrome liquid developer is directly transferred from a photoconductor to paper, or a multi-color image formation apparatus forming a color image by layering a plurality of types of liquid developers.

EXAMPLES

Though the present invention will be described hereinafter in further detail with reference to Examples, the present invention is not limited thereto.

Manufacturing Example 1

Manufacturing of Dispersion Liquid (W1) of Shell Particles

In a beaker made of glass, 100 parts by mass of 2-decyltetradecyl (meth)acrylate, 30 parts by mass of methacrylic acid, 70 parts by mass of an equimolar reactant with hydroxyethyl methacrylate and phenyl isocyanate, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was introduced in the reaction vessel and caused to react for 3 hours at 70° C. Thereafter, cooling to room temperature was carried out. Thus, a copolymer solution was obtained. THF was removed from the obtained copolymer solution, and the shell resin in a dry state was fabricated. A glass transition point of the shell resin was measured and it was 53° C.

Four hundred parts by mass of the obtained copolymer solution were dropped in 600 parts by mass of IP Solvent 2028 (manufactured by Idemitsu Kosan Co., Ltd.) which was being stirred, and THF was distilled out at 40° C. at a reduced pressure of 0.039 MPa. Thus, a dispersion liquid (W1) of shell particles was obtained. A volume average particle size of the shell particles in the dispersion liquid (W1) was measured with a laser particle size distribution analyzer ("LA-920" manufactured by Horiba, Ltd.), which was 0.12

Manufacturing Example 2

Manufacturing of Dispersion Liquid (W2) of Shell Particles

In a reaction vessel provided with a stirrer, a heating and cooling apparatus, a thermometer, a cooling pipe, and a nitrogen introduction pipe, 286 parts by mass of dodecane dicarboxylic acid, 190 parts by mass of 1,6-hexanediol, and 1 part by mass of titanium dihydroxybis(triethanolaminate) as a condensation catalyst were introduced. These were caused to react for 8 hours under a nitrogen current at 180° C. while generated water was distilled out. Then, while a temperature was gradually raised to 220° C. and generated water was distilled out, they were caused to react for 4 hours under a nitrogen current. In addition, they were caused to react for 1 hour at a reduced pressure from 0.007 to 0.026 MPa. Thus, a polyester resin was obtained. The obtained polyester resin had a melting point of 68° C. and Mn of 4900.

In a beaker made of glass, 80 parts by mass of 2-decyltetradecyl (meth)acrylate, 5 parts by mass of methyl methacrylate, 5 parts by mass of methacrylic acid, an isocyanate-containing monomer (trade name: "Karenz MOI" manufactured by Showa Denko K.K.), 20 parts by mass of the polyester resin obtained with the method above, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was introduced in the reaction vessel and caused to react for 3 hours at 70° C. Thereafter, cooling to room temperature was carried out. Thus, a copolymer solution was obtained. THF was removed from the obtained copolymer solution, and the shell resin in a dry state was fabricated. A glass transition point of the shell resin was measured and it was 47° C.

Four hundred parts by mass of the obtained copolymer solution were dropped in 600 parts by mass of IP Solvent 2028 (manufactured by Idemitsu Kosan Co., Ltd.) which was being stirred, and THF was distilled out at 40° C. at a reduced pressure of 0.039 MPa. Thus, a dispersion liquid (W2) of shell particles was obtained. A volume average particle size of the shell particles (A1) in the dispersion liquid (W2) was measured with a laser particle size distribution analyzer ("LA-920" manufactured by Horiba, Ltd.), which was 0.13 μm.

Manufacturing Example 3

Manufacturing of Solution for Dispersant

Two hundred parts by mass of Solsperse 11200 (manufactured by Japan Lubrizol Limited) were dissolved in 80 parts by mass of IP Solvent 2028. Thus, a solution for dispersant was obtained.

Manufacturing Example 4

Manufacturing of Solution (Y1) for Forming Core Resin

In a reaction vessel provided with a stirrer, a heating and cooling apparatus, and a thermometer, 970 parts by mass of polyester resin (a number average molecular weight: 5415) obtained from sebacic acid, adipic acid, and ethylene glycol (a molar ratio of 0.8:0.2:1) and 300 parts by mass of acetone were introduced and dissolved uniformly by stirring. In this solution, 30 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b1) was obtained. A number average molecular weight of the obtained core resin (b1) was 23000 and a concentration of a urethane group therein was 1.6. One thousand parts by mass of this core resin (b1) and 1000 parts by mass of acetone were introduced in a beaker and stirred, to thereby uniformly dissolve the core resin (b1) in acetone. Thus, a solution (Y1) for forming the core resin was obtained.

Manufacturing Example 5

Manufacturing of Solution (Y2) for Forming Core Resin

In a reaction vessel provided with a stirrer, a heating and cooling apparatus, and a thermometer, 890 parts by mass of polyester resin (a number average molecular weight: 1400) obtained from sebacic acid, adipic acid, and ethylene glycol (a molar ratio of 0.8:0.2:1) and 300 parts by mass of acetone were introduced and dissolved uniformly by stirring. In this solution, 107 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b2) was obtained. A number average molecular weight of the obtained core resin (b2) was 13000 and a concentration of a urethane group therein was 6.5. One thousand parts by mass of this core resin (b2) and 1000 parts by mass of acetone were introduced in a beaker and stirred, to thereby uniformly dissolve the core resin (b2) in acetone. Thus, a solution (Y2) for forming the core resin was obtained.

Manufacturing Example 6

Manufacturing of Solution (Y3) for Forming Core Resin

In a reaction vessel provided with a stirrer, a heating and cooling apparatus, and a thermometer, 970 parts by mass of polyester resin (a number average molecular weight: 4762) obtained from sebacic acid, adipic acid, and ethylene glycol (a molar ratio of 0.8:0.2:1) and 300 parts by mass of acetone were introduced and dissolved uniformly by stirring. In this solution, 30 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b3) was obtained. A number average molecular weight of the obtained core resin (b3) was 13000 and a concentration of a urethane group therein was 1.5. One thousand parts by mass of this core resin (b3) and 1000 parts by mass of acetone were introduced in a beaker and stirred, to thereby uniformly dissolve the core resin (b3) in acetone. Thus, a solution (Y3) for forming the core resin was obtained.

Manufacturing Example 7

Manufacturing of Solution (Y4) for Forming Core Resin

In a reaction vessel provided with a stirrer, a heating and cooling apparatus, and a thermometer, 970 parts by mass of polyester resin (a number average molecular weight: 6504) obtained from sebacic acid, adipic acid, and ethylene glycol (a molar ratio of 0.8:0.2:1) and 300 parts by mass of acetone were introduced and dissolved uniformly by stirring. In this solution, 28 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b4) was obtained. A number average molecular weight of the obtained core resin (b4) was 45000 and a concentration of a urethane group therein was 1.5. One thousand parts by mass of this core resin (b4) and 1000 parts by mass of acetone were introduced in a beaker and stirred, to thereby uniformly dissolve the core resin (b4) in acetone. Thus, a solution (Y4) for forming the core resin was obtained.

Manufacturing Example 8

Manufacturing of Solution (Y5) for Forming Core Resin

In a reaction vessel provided with a stirrer, a heating and cooling apparatus, and a thermometer, 920 parts by mass of polyester resin (a number average molecular weight: 2207) obtained from sebacic acid, adipic acid, and ethylene glycol (a molar ratio of 0.8:0.2:1) and 300 parts by mass of acetone were introduced and dissolved uniformly by stirring. In this solution, 85 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b5) was obtained. A number average molecular weight of the obtained core resin (b5) was 30000 and a concentration of a urethane group therein was 4.5. One thousand parts by mass of this core resin (b5) and 1000 parts by mass of acetone were introduced in a beaker and stirred, to thereby uniformly dissolve the core resin (b5) in acetone. Thus, a solution (Y5) for forming the core resin was obtained.

Manufacturing Example 9

Manufacturing of Solution (Y6) for Forming Core Resin

In a reaction vessel provided with a stirrer, a heating and cooling apparatus, and a thermometer, 990 parts by mass of polyester resin (a number average molecular weight: 11531) obtained from sebacic acid, adipic acid, and ethylene glycol (a molar ratio of 0.8:0.2:1) and 300 parts by mass of acetone were introduced and dissolved uniformly by stirring. In this solution, 10 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b6) was obtained. A number average molecular weight of the obtained core resin (b6) was 23000 and a concentration of a urethane group therein was 0.5. One thousand parts by mass of this core resin (b6) and 1000 parts by mass of acetone were introduced in a beaker and stirred, to thereby uniformly dissolve the core resin (b6) in acetone. Thus, a solution (Y6) for forming the core resin was obtained.

Manufacturing Example 10

Manufacturing of Solution (Y7) for Forming Core Resin

In a reaction vessel provided with a stirrer, a heating and cooling apparatus, and a thermometer, 970 parts by mass of polyester resin (a number average molecular weight: 6656) obtained from sebacic acid, adipic acid, and ethylene glycol (a molar ratio of 0.8:0.2:1) and 300 parts by mass of acetone were introduced and dissolved uniformly by stirring. In this solution, 30 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b7) was obtained. A number average molecular weight of the obtained core resin (b7) was 53000 and a concentration of a urethane group therein was 1.5. One thousand parts by mass of this core resin (b7) and 1000 parts by mass of acetone were introduced in a beaker and stirred, to thereby uniformly dissolve the core resin (b7) in acetone. Thus, a solution (Y7) for forming the core resin was obtained.

Manufacturing Example 11

Manufacturing of Solution (Y8) for Forming Core Resin

In a reaction vessel provided with a stirrer, a heating and cooling apparatus, and a thermometer, 910 parts by mass of polyester resin (a number average molecular weight: 1995) obtained from sebacic acid, adipic acid, and ethylene glycol (a molar ratio of 0.8:0.2:1) and 300 parts by mass of acetone were introduced and dissolved uniformly by stirring. In this solution, 90 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b8) was obtained. A number average molecular weight of the obtained core resin (b8) was 33000 and a concentration of a urethane group therein was 5.0. One thousand parts by mass of this core resin (b8) and 1000 parts by mass of acetone were introduced in a beaker and stirred, to thereby uniformly dissolve the core resin (b8) in acetone. Thus, a solution (Y8) for forming the core resin was obtained.

Manufacturing Example 12

Manufacturing of Solution (Y9) for Forming Core Resin

In a reaction vessel provided with a stirrer, a heating and cooling apparatus, and a thermometer, 940 parts by mass of polyester resin (a number average molecular weight: 2077) obtained from sebacic acid, adipic acid, and ethylene glycol (a molar ratio of 0.8:0.2:1) and 300 parts by mass of acetone were introduced and dissolved uniformly by stirring. In this solution, 60 parts by mass of isophoron diisocyanate (IPDI) were introduced and caused to react for 6 hours at 80° C. When an NCO value attained to 0, 28 parts by mass of terephthalic acid were added and caused to react for 1 hour at 180° C. Thus, a core resin (b9) was obtained. A number average molecular weight of the obtained core resin (b9) was 5000 and a concentration of a urethane group therein was 3.0. One thousand parts by mass of this core resin (b9) and 1000 parts by mass of acetone were introduced in a beaker and stirred, to thereby uniformly dissolve the core resin (b9) in acetone. Thus, a solution (Y9) for forming the core resin was obtained.

Manufacturing Example 13

Manufacturing of Solution (Y10) for Forming Core Resin

In a reaction vessel provided with a stirrer, a heating and cooling apparatus, and a thermometer, a polyester resin (a number average molecular weight: 2500) obtained from terephthalic acid, adipic acid, and an adduct of propylene oxide to bisphenol A (a molar ratio of 0.8:0.2:1) was obtained. A number average molecular weight of an obtained core resin (b10) was 3500 and a concentration of a urethane group therein was 1.2. One thousand parts by mass of this core resin (b10) and 1000 parts by mass of acetone were introduced in a beaker and stirred, to thereby uniformly dissolve a core resin (b10) in acetone. Thus, a solution (Y10) for forming the core resin not having crystallinity was obtained.

Manufacturing Example 14

Manufacturing of Dispersion Liquid (P1) of Coloring Agent

In a beaker, 20 parts by mass of acid-treated copper phthalocyanine "FASTGEN Blue FDB-14" manufactured by DIC Corporation", 5 parts by mass of a dispersant for pigment "Ajisper PB-821" (manufactured by Ajinomoto Fine-Techno Co., Inc.), and 75 parts by mass of acetone were introduced and stirred, for uniform dispersion. Thereafter, copper phthalocyanine was finely dispersed with the use of a bead mill. Thus, a dispersion liquid (P1) of a coloring agent was obtained. A laser particle size distribution analyzer ("LA-920" manufactured by Horiba, Ltd.) was used to measure a volume average particle size of copper phthalocyanine in the dispersion liquid (P1) of the coloring agent, which was 0.2 μm.

Example 1

Forty parts by mass of the solution (Y1) for forming the core resin and 20 parts by mass of the dispersion liquid of the coloring agent (P1) were introduced in a beaker and stirred at 8000 rpm with the use of TK Auto Homo Mixer (manufactured by PRIMIX Corporation) at 25° C. Thus, a resin solution (Y11) in which the pigment was uniformly dispersed was obtained.

In another beaker, 67 parts by mass of IP Solvent 2028 (manufactured by Idemitsu Kosan Co., Ltd.) and 11 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y11) were introduced and stirred for 2 minutes.

A liquid mixture thus obtained was introduced in a reaction vessel provided with a stirrer, a heating and cooling apparatus, a thermometer, and a desolventizer, and a temperature was raised to 35° C. At a reduced pressure of 0.039 MPa at 35° C., acetone was distilled out until a concentration of acetone in the liquid mixture described above was not higher than 0.5 mass %. Thus, a liquid developer (X-1) was obtained. The solid content of the obtained liquid developer (X-1) contained 17 mass % of copper phthalocyanine.

Examples 2 to 5 and Comparative Examples 1 to 5

Liquid developers in Examples 2 to 5 and Comparative Examples 1 to 5 were manufactured in accordance with the method the same as in Example 1 above, except that the solutions (Y2 to Y10) for forming the core resin were employed instead of the solution (Y1) for forming the core resin.

Example 6

A liquid developer in Example 6 was manufactured in accordance with the method the same as in Example 1 above, except that the dispersion liquid (W2) of shell particles was employed instead of the dispersion liquid (W1) of shell particles.

Comparative Example 6

A liquid developer in Comparative Example 6 was manufactured in accordance with the method the same as in Example 1 above, except that the solution for dispersant in Manufacturing Example 3 was employed instead of the dispersion liquid (W1) of shell particles.

<Crystallinity of Core Resin>

Twelve standard polyesters (TSK standard POLYSTYRENE manufactured by Tosoh Corporation) (molecular weight: 500, 1050, 2800, 5970, 9100, 18100, 37900, 96400, 190000, 355000, 1090000, 2890000) were employed as standard samples, standard polyesters and resins contained in toner particles in Examples 1 to 6 and Comparative Examples 1 to 6 were heated from 0° C. to 180° C. at a rate of 10° C./min., and a difference between an amount of heat of the standard sample and an amount of heat of the resin was measured. Then, a difference in amount of heat H1 at the time of first temperature increase and a difference in amount of heat H2 at the time of second temperature increase were found.

<Measurement of Storage Elastic Modulus of Solid Content of Liquid Developer>

Approximately 5 g of the liquid developer was taken for centrifugation, for removal of a supernatant. Thereafter, cleaning with hexane was carried out, and then drying for 2 hours at a room temperature was carried out with the use of a vacuum dryer. A viscoelasticity measurement apparatus (ARES of TA Instruments, Japan) was used to measure viscoelasticity of a dried sample (the solid content of the liquid developer) under conditions shown below.

Jig: Parallel plates each having a thickness of 8 mm
Frequency: 1 Hz
Distortion factor: 1%
Rate of temperature increase: 3° C./min.
Range of measurement temperature: 40 to 160° C.

A storage elastic modulus at 80° C. of the solid content of the liquid developer and a softening start temperature of the solid content of the liquid developer were found based on obtained viscoelasticity characteristics. Table 2 shows results.

In addition, temperature dependency of $|\Delta \log(G')/\Delta T|$ was examined. Then, a peak derived from softening of the crystalline resin was clearly observed in Examples 1 to 6 and Comparative Examples 1 to 4 and 6, whereas a peak derived from softening of the crystalline resin could not be observed in Comparative Example 5. Therefore, it was found that the core resin in each of Examples 1 to 6 and Comparative Examples 1 to 4 and 6 contained the crystalline resin, whereas the core resin in Comparative Example 5 did not contain the crystalline resin.

<Fixation Process>

Figure 3:
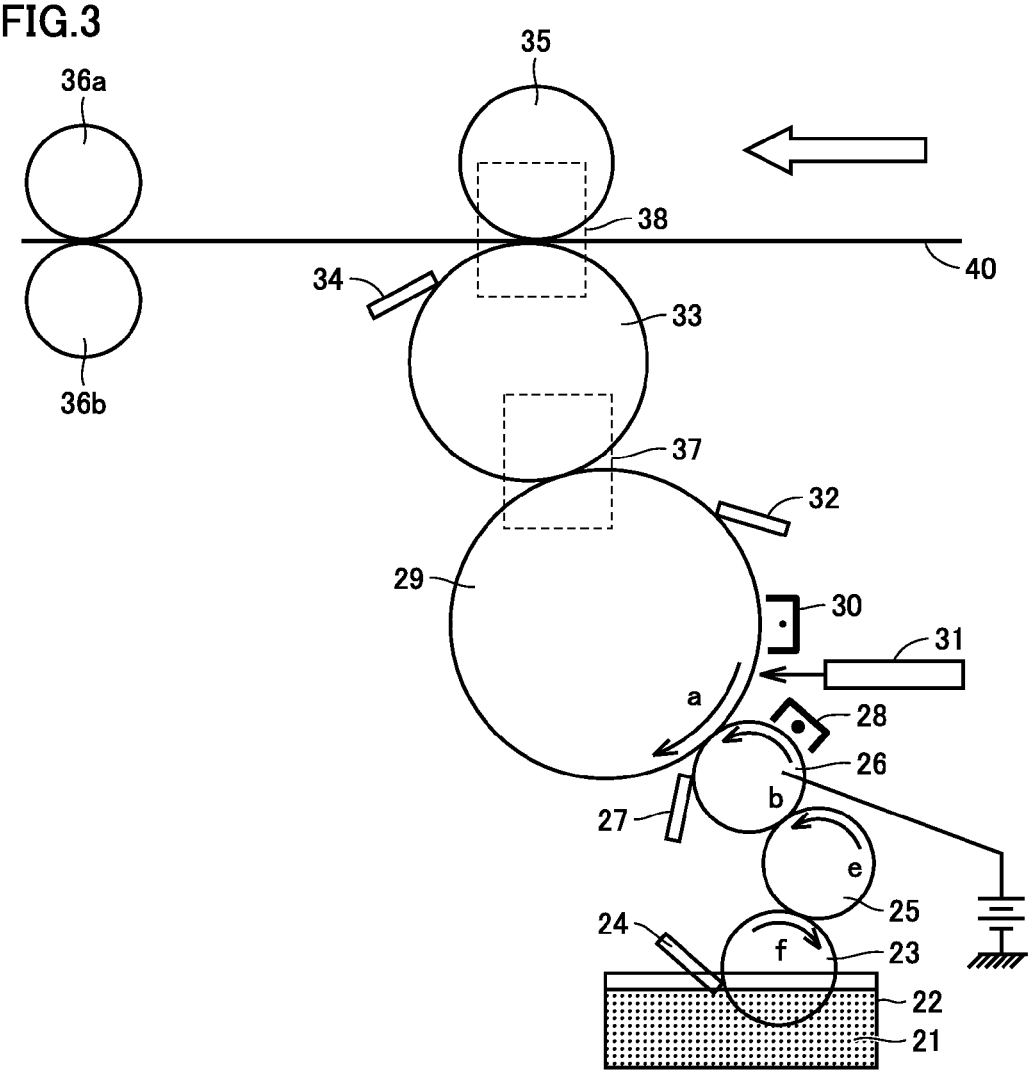
FIG. 3 is a schematic conceptual diagram of an image formation apparatus of an electrophotography type.

An image was formed by using an image formation apparatus shown in FIG. 3. A construction of the image formation apparatus shown in FIG. 3 is shown below. A liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. The excessive liquid developer on development roller 26 is scraped off by a development cleaning blade 27, and remaining liquid developer 21 is charged by a development charger 28 and developed on a photoconductor 29. Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to a recording medium 40 such as paper at a secondary transfer portion 38. The liquid developer transferred to recording medium 40 is fixed by fixation rollers 36*a* and 36*b*. The liquid developer which remained on intermediate transfer element 33 without being secondarily transferred is scraped off by an intermediate transfer element cleaning portion 34.

In the present Example, the surface of photoconductor 29 was positively charged by charging portion 30, a potential of intermediate transfer element 33 was set to −400 V, and a potential of a secondary transfer roller 35 was set to −1200 V. OK top coat+(manufactured by Oji Paper Co., Ltd., 127 g/m$^2$) was employed as a recording medium, an amount of adhesion of toner particles to the recording medium was 2 g/m$^2$, and a velocity at which the recording medium passes between fixation rollers 36*a* and 36*b* was set to 20 m/s. A temperature of fixation rollers 36*a* and 36*b* was 80° C. A surface linear velocity (a process speed) of photoconductor 29 was set to 400 mm/s.

<High-Temperature Offset>

Immediately after an image was formed with the use of the image formation apparatus shown in FIG. 3, white paper (OK top coat+above) was passed between the fixation rollers. Results are shown in "High Temperature" in Table 2. In Table 2, a case that white paper after passage between the fixation rollers was not contaminated with toner is denoted as "A1", a case that white paper after passage between the fixation rollers was slightly contaminated with toner is denoted as "B1", and a case that white paper after passage between the fixation rollers was clearly contaminated with toner is denoted as "C1". Here, contamination of white paper with toner after passage between the fixation rollers means adhesion of toner to a circumferential surface of the fixation roller and means occurrence of high-temperature offset.

<Document Offset>

While surfaces having images formed were layered on each other with load of 80 g/m$^2$ being applied thereto, two recording media having the images formed were stored for 1 week in an environment at 50° C. Thereafter, two recording media were separated from each other and whether or not the images were damaged at the time of separation was checked. Results are shown in "Do" in Table 2. In Table 2, a case that the two recording media could be separated from each other without damage to the images and fracture of a recording medium is denoted as A2, a case that damage to the images or fracture of a recording medium slightly occurred at the time of separation of the two recording media from each other is denoted as B2, and a case that damage to the images or fracture of a recording medium occurred at the time of separation of the two recording media from each other is denoted as C2. It can be concluded that no document offset took place if the two recording media could be separated from each other without damage to the images and fracture of a recording medium.

<Fixability>

A tape ("Scotch® mending tape" manufactured by Sumitomo 3M Limited) was stuck to an image fixed with the use of the image formation apparatus shown in FIG. 3, and thereafter the tape was gently peeled off. Reflection density of an image (ID) which adhered to the peeled tape was determined. Results are shown in "Fixation" in Table 2. In Table 2, a case of reflection density of an image <0.1 is denoted as A3 and a case of 0.1≤reflection density of an image is denoted as C3. It can be concluded that lower reflection density of an image indicates less likeliness of peel-off of a fixed image by the tape and hence such a liquid developer is excellent in fixability.

<Degree of Gloss>

Seventy-five-degree Gloss Meter (VG-2000 manufactured by Nippon Denshoku Industries Co., Ltd.) was used to measure a degree of gloss of a fixed image. Results are shown in "Gloss" in Table 2. In Table 2, a degree of gloss not lower than 50 is denoted as A4, and a degree of gloss lower than 50 is denoted as C4. As a degree of gloss is higher, it can be concluded that such a liquid developer is excellent in glossiness.

TABLE 1

| Core Particles | Mn | x | y |
|---|---|---|---|
| Y1 | 5415 | 23000 | 1.6 |
| Y2 | 1400 | 13000 | 6.5 |
| Y3 | 4762 | 13000 | 1.5 |
| Y4 | 6504 | 45000 | 1.5 |
| Y5 | 2207 | 30000 | 4.5 |
| Y6 | 11531 | 23000 | 0.5 |
| Y7 | 6656 | 53000 | 1.5 |
| Y8 | 1995 | 33000 | 5 |
| Y9 | 2077 | 5000 | 3 |
| Y10 | 2500 | 3500 | 1.2 |

In Table 1,

Mn represents a number average molecular weight of the polyester resin before urethane modification, x represents a number average molecular weight of the urethane-modified polyurethane resin, and y represents a concentration of a urethane group in the urethane-modified polyester resin.

TABLE 2

| | Core | Shell | x | y | Tmp/° C. | G'(80)/Pa | Tg/° C. | High Temperature | Do | Fixation | Gloss |
|---|---|---|---|---|---|---|---|---|---|---|---|
| Example 1 | Y1 | W1 | 23000 | 1.6 | 57 | $3.2 \times 10^5$ | 50 | A1 | A2 | A3 | A4 |
| Example 2 | Y2 | W1 | 13000 | 6.5 | 55 | $4.3 \times 10^4$ | 50 | A1 | A2 | A3 | A4 |
| Example 3 | Y3 | W1 | 13000 | 1.5 | 62 | $1.8 \times 10^4$ | 50 | A1 | A2 | A3 | A4 |
| Example 4 | Y4 | W1 | 45000 | 1.5 | 51 | $4.9 \times 10^6$ | 50 | A1 | A2 | A3 | A4 |
| Example 5 | Y5 | W1 | 30000 | 4.5 | 50 | $4.4 \times 10^6$ | 50 | A1 | A2 | A3 | A4 |
| Example 6 | Y1 | W2 | 23000 | 1.6 | 56 | $3.2 \times 10^5$ | 47 | B1 | B2 | A3 | A4 |
| Comparative Example 1 | Y6 | W1 | 23000 | 0.5 | 58 | $0.9 \times 10^4$ | 50 | C1 | A2 | A3 | A4 |
| Comparative Example 2 | Y7 | W1 | 53000 | 1.5 | 45 | $5.2 \times 10^6$ | 50 | A1 | C2 | C3 | C4 |
| Comparative Example 3 | Y8 | W1 | 33000 | 5 | 47 | $5.1 \times 10^6$ | 50 | A1 | C2 | A3 | A4 |
| Comparative Example 4 | Y9 | W1 | 5000 | 3 | 60 | $0.8 \times 10^4$ | 50 | C1 | A2 | A3 | A4 |
| Comparative Example 5 | Y10 | W1 | 3500 | 1.2 | None | $7.3 \times 10^6$ | 55 | A1 | A2 | C3 | C4 |
| Comparative Example 6 | Y1 | Dispersant | 23000 | 1.6 | 47 | $3.1 \times 10^5$ | None | B1 | C2 | A3 | A4 |

In Table 2,

Core represents core particles,

Shell represents shell particles, x represents a number average molecular weight of the urethane-modified polyurethane resin, y represents a concentration of a urethane group in the urethane-modified polyester resin, Tmp represents a softening start temperature of the solid content of the liquid developer, G'(80) represents a storage elastic modulus at 80° C. of the solid content of the liquid developer, and Tg represents a glass transition point of the shell resin used.

<Discussion>

As shown in Table 2, in Examples 1 to 6, toner particles could be fixed at a low temperature, glossiness was excellent, and occurrence of high-temperature offset and document offset could be prevented. The reason may be because, in Examples 1 to 6, the core resin contained the crystalline urethane-modified polyester resin, the solid content of the liquid developer had a storage elastic modulus at 80° C., not lower than $1\times10^4$ Pa and not higher than $5\times10^6$ Pa, and a softening start temperature of the solid content of the liquid developer was not lower than 45° C. In addition, the reason may also be because, in Examples 1 to 6, the crystalline urethane-modified polyester resin contained in the core resin satisfied Equations (2) to (4) above.

In Examples 1 to 5, occurrence of document offset could be prevented further than in Example 6. The reason may be because the shell resin had a glass transition point not lower than 50° C. in Examples 1 to 5.

Figure 4:
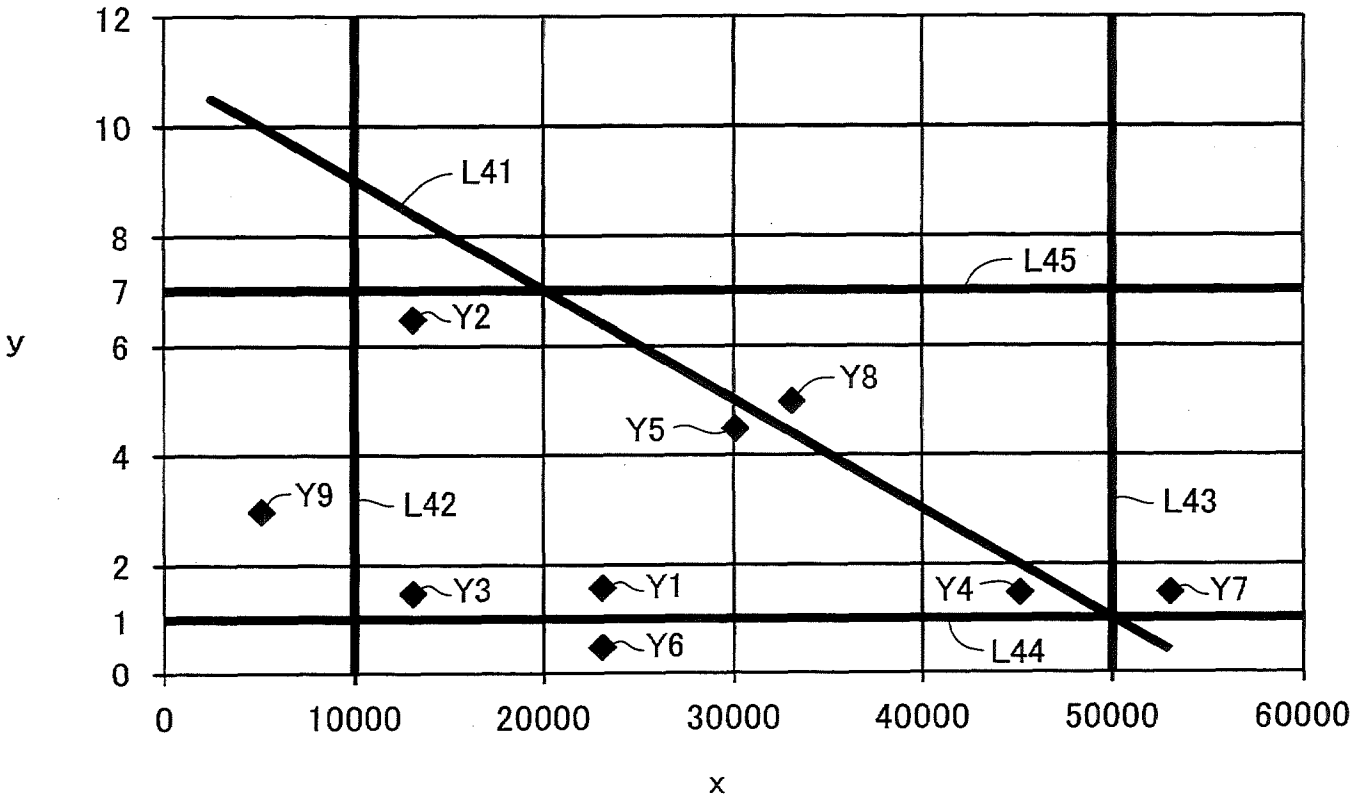
FIG. 4 is a graph showing results in Examples.

Results shown in Table 2 will be discussed further with reference to FIG. 4. FIG. 4 is a graph showing relation between a number average molecular weight x of the urethane-modified polyester resin and a concentration of a urethane group y in the urethane-modified polyester resin. In FIG. 4, Y1 to Y9 represent the core particles (Y1) to (Y9), respectively.

In Comparative Example 1, high-temperature offset occurred. The reason may be because, in Comparative Example 1 (the core particles (Y6)), a concentration of a urethane group y in the crystalline urethane-modified polyester resin was lower than in Examples 1, 3, 4, and 6 (the core particles (Y1), (Y3), and (Y4)).

In Comparative Example 2, fixability and glossiness were not good. The reason may be because the solid content of the liquid developer had a storage elastic modulus at 80° C. exceeding $5\times10^6$ Pa.

In addition, in Comparative Example 2, document offset occurred. The reason may be because a concentration of a urethane group y in the crystalline urethane-modified polyester resin exhibited a value the same in Example 4 (the core particles (Y4)) and Comparative Example 2 (the core particles (Y7)), however, the number average molecular weight x of the crystalline urethane-modified polyester resin was lower in Example 4 than in Comparative Example 2.

In Comparative Example 3, document offset occurred. The reason may be because a concentration of a urethane group y in the crystalline urethane-modified polyester resin exhibited a value substantially the same in Example 5 (the core particles (Y5)) and Comparative Example 3 (the core particles (Y8)), however, the number average molecular weight x of the crystalline urethane-modified polyester resin was lower in Example 5 than in Comparative Example 3.

In Comparative Example 4 (the core particles (Y9)), the number average molecular weight x of the crystalline urethane-modified polyester resin was lower than in Examples 2 and 3 (the core particles (Y2) and (Y3)). Therefore, it is considered that toner particles were likely to melt during fixation and hence high-temperature offset occurred.

In Comparative Example 5, it is considered that the solid content of the liquid developer did not have a softening start temperature (that is, the core resin did not have crystallinity), and hence fixability and glossiness were not good.

In Comparative Example 6, it is considered that the liquid developer did not have a core-shell structure, and hence high-temperature offset and document offset occurred.

It was found that the core resins (the core particles (Y1) to (Y5)) in Examples 1 to 6 were present in a region surrounded by L41 to L45, whereas the core resins (the core particles (Y6) to (Y9)) in Comparative Examples 1 to 6 were present outside the region surrounded by L41 to L45. Therefore, it was found that, when the number average molecular weight x of the crystalline urethane-modified polyester resin and the concentration of the urethane group y in the urethane-modified polyester resin were within the region surrounded by L41 to L45 shown in FIG. 4, a liquid developer having ensured fixability and glossiness, with which occurrence of high-temperature offset and document offset could be prevented, could be provided. L41 represents a straight line $y=-0.0002x+11$, L42 represents a straight line $x=10000$, L43 represents a straight line $x=50000$, L44 represents a straight line $y=1$, and L45 represents a straight line $y=7$. Therefore, it was found that, when the number average molecular weight x of the urethane-modified polyester resin and the concentration of the urethane group y in the urethane-modified polyester resin satisfied Equations (2) to (4) above, a liquid developer having ensured fixability and glossiness, with which occurrence of high-temperature offset and document offset could be prevented, could be provided. Since the core particles (Y10) are non-crystalline, they are not shown in FIG. 4.

Though the embodiments and the examples of the present invention have been described above, combination of features in each embodiment and example described above as appropriate is also originally intended.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer, comprising:

an insulating liquid; and toner particles dispersed in said insulating liquid, said toner particles containing a core resin, a shell resin different from said core resin, and a coloring agent, said core resin containing a crystalline urethane-modified polyester resin, a solid content of said liquid developer corresponding to a portion of said liquid developer excluding said insulating liquid having a storage elastic modulus at 80° C., not lower than $1\times10^4$ Pa and not higher than $5\times10^6$ Pa, and a lowest temperature when an absolute value of an amount of change in a logarithmic value (log(G')) of a storage elastic modulus (G') of the solid content of said liquid developer with respect to a temperature T (° C.) ($|\Delta \log(G')/\Delta T|$) satisfies an Equation (1) below being not lower than 45° C.:

$$|\Delta \log(G')/\Delta T|>0.1 \quad \text{Equation (1).}$$

2. The liquid developer according to claim 1, wherein x and y satisfy Equations (2) to (4) below:

$$y\leq-0.0002x+11 \quad \text{Equation (2);}$$

$$10000\leq x\leq50000 \quad \text{Equation (3); and}$$

$$1\leq y\leq7 \quad \text{Equation (4),}$$

where x represents a number average molecular weight of said urethane-modified polyester resin and y represents a concentration of a urethane group in said urethane-modified polyester resin.

3. The liquid developer according to claim 1, wherein the solid content of said liquid developer has a storage elastic modulus at 80° C., not lower than $5\times10^4$ Pa and not higher than $1\times10^6$ Pa.

4. The liquid developer according to claim 1, wherein said shell resin has a glass transition point not lower than 50° C.

* * * * *